US007991313B2

(12) United States Patent
Hotogi et al.

(10) Patent No.: US 7,991,313 B2
(45) Date of Patent: Aug. 2, 2011

(54) IMAGE FORMING APPARATUS

(75) Inventors: Tatsuya Hotogi, Suntou-gun (JP); Shimpei Matsuo, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 307 days.

(21) Appl. No.: 12/416,834

(22) Filed: Apr. 1, 2009

(65) Prior Publication Data

US 2009/0252515 A1 Oct. 8, 2009

(30) Foreign Application Priority Data

Apr. 2, 2008 (JP) ..... 2008-096093

(51) Int. Cl.
*G03G 15/06* (2006.01)
*G03G 15/00* (2006.01)
*H01L 41/00* (2006.01)

(52) U.S. Cl. ..... 399/55; 399/27; 399/28; 399/237

(58) Field of Classification Search ..... 399/9, 24, 399/27–29, 38, 53, 55, 537, 241
See application file for complete search history.

(56) References Cited

U.S. PATENT DOCUMENTS

2007/0025753 A1* 2/2007 Saito et al. ..... 399/88
2008/0260402 A1* 10/2008 Yasukawa ..... 399/66
2009/0052918 A1* 2/2009 Toda et al. ..... 399/55
2009/0154942 A1* 6/2009 Hotogi et al. ..... 399/27

FOREIGN PATENT DOCUMENTS

JP 8-44184 2/1996

* cited by examiner

*Primary Examiner* — David P Porta
*Assistant Examiner* — Jessica L Eley
(74) *Attorney, Agent, or Firm* — Canon USA Inc IP Division

(57) ABSTRACT

An image forming apparatus includes an alternating-current high-voltage power supply generating an alternating-current bias for detection of the remaining amount of toner. The alternating-current high-voltage power supply includes a piezoelectric transformer, a piezoelectric-transformer driving unit, a piezoelectric-transformer driving-signal generating unit, a voltage detecting unit, a voltage setting unit, and an controlling unit that feeds back a difference signal between a detection level signal supplied from a detection signal detecting unit and a setting signal supplied from the voltage setting unit to the piezoelectric-transformer driving-signal generating unit to control an output voltage from the piezoelectric-transformer.

11 Claims, 15 Drawing Sheets

IMAGE FORMING APPARATUS

BACKGROUND OF THE INVENTION

1. Field of the Invention

The present invention relates to an image forming apparatus adopting a technology for detecting the remaining amount of toner.

2. Description of the Related Art

Electrostatic-capacitance detection methods are in widespread use as mechanisms for detecting the remaining amounts of toner in image forming apparatuses using electrophotographic processes. Such electrostatic-capacitance detection methods are disclosed in, for example, Japanese Patent Laid-Open No. 8-44184.

FIGS. 14 and 15 schematically show examples of the configurations of mechanisms for detecting the remaining amount of developer by the electrostatic-capacitance detection method. Toner is used as the developer in the example in FIGS. 14 and 15. A toner container 100 is a container of the developer, and a developing roller 101 is a developer carrier that is provided in the container of the developer and carries and conveys the developer. Referring to FIG. 14, an antenna 104 is a conductor that opposes the developing roller 101 and that is away from the developing roller 101 by a predetermined distance. The antenna 104 and the developing roller 101 form a pair of counter electrodes and an electrostatic capacitance is formed between the antenna 104 and the developing roller 101. The amount of toner between the developing roller 101 and the antenna 104 is decreased as toner 20 in the toner container 100 is consumed to decrease the permittivity between the developing roller 101 and the antenna 104 and also to decrease the electrostatic capacitance therebetween. The difference in voltage between the electrodes is measured to detect a variation in the electrostatic capacitance in order to detect the remaining amount of the toner 20 in the toner container 100. Specifically, when a predetermined alternating (AC) voltage is applied to the developing roller 101 by an AC power supply 105 for detection of the remaining amount of toner, an AC current $I_1$ is generated in accordance with the electrostatic capacitance of an equivalent capacitor 106 formed between the developing roller 101 and the antenna 104. The AC current $I_1$ is in proportion to the product of the frequency of the AC power supply 105 for detection of the remaining amount of toner, the amplitude thereof, and the electrostatic capacitance of the equivalent capacitor 106. The AC current $I_1$ is rectified by a rectifier circuit including diodes 201 and 202, a resistor 203, and a capacitor 204 to convert the AC current $I_1$ into a voltage $V_1$ and the voltage $V_1$ is supplied to the inverting input terminal of an operational amplifier 108. Similarly, when a predetermined AC voltage is applied to a reference capacitor 107 by the AC power supply 105 for detection of the remaining amount of toner, an AC current $I_2$ is generated in accordance with the electrostatic capacitance of the reference capacitor 107. The AC current $I_2$ is rectified by a rectifier circuit including diodes 205 and 206, a resistor 207, and a capacitor 208 to convert the AC current $I_2$ into a reference voltage $V_2$ for detection of the remaining amount of toner and the reference voltage $V_2$ is supplied to the non-inverting input terminal of the operational amplifier 108. The operational amplifier 108, resistors 209 and 210, and a capacitor 211 form an integration circuit, and the difference between the voltage $V_1$ and the reference voltage $V_2$ supplied to the inverting input terminal and the non-inverting input terminal of the operational amplifier 108, respectively, is amplified to be detected as a detection result 109. It is possible to subsequently detect the remaining amount of the toner 20 in the toner container 100 as an analog quantity in the above manner.

Referring to FIG. 15, an RS roller 102 including a dielectric material is in contact with the developing roller 101 to supply the toner to the developing roller 101. The RS roller 102 serves as an electrode member to from a pair of counter electrodes with the developing roller 101. The difference in voltage between the developing roller 101 and the RS roller 102 is measured to detect a variation in the electrostatic capacitance therebetween in order to detect the remaining amount of the toner 20 in the toner container 100.

The AC current $I_1$ is generated in accordance with the electrostatic capacitance of the equivalent capacitor 106 formed between the antenna 104 and the developing roller 101 or between the RS roller 102 and the developing roller 101. The AC current $I_1$ is represented by Equation (1):

$$I_1=2\pi f\cdot Vpp\cdot Ct \tag{1}$$

where "f" denotes the frequency of an AC voltage 30 for detection of the remaining amount of toner, "Vpp" denotes the amplitude thereof, and "Ct" denotes the electrostatic capacitance of the equivalent capacitor.

Similarly, the AC current $I_2$ generated in accordance with the electrostatic capacitance of the reference capacitor 107 is represented by Equation (2):

$$I_2=2\pi f\cdot Vpp\cdot \mathrm{Cref} \tag{2}$$

where "Cref" denotes the electrostatic capacitance of the reference capacitor.

In general, the electrostatic capacitance Ct of the equivalent capacitor has frequency characteristics different from those of the electrostatic capacitance Cref of the reference capacitor. In addition, the rectifier circuits that rectify the AC current $I_1$ and the AC current $I_2$ to convert the AC current $I_1$ and the AC current $I_2$ into the voltage $V_1$ and the reference voltage $V_2$, respectively, also have frequency characteristics. Accordingly, in order to compare the AC current $I_1$ with the AC current $I_2$, that is, in order to compare the voltage $V_1$ with the reference voltage $V_2$ to perform the satisfactory comparison between the electrostatic capacitance of the equivalent capacitor and that of the reference capacitor, it is necessary to keep the frequency f of the AC voltage 30 for detection of the remaining amount of toner and the amplitude Vpp thereof constant in Equations (1) and (2). Consequently, it is preferred that the amplitude Vpp of the AC voltage 30 for detection of the remaining amount of toner be kept constant and that the AC voltage 30 for detection of the remaining amount of toner have a substantially sine waveform so that the a single frequency that does not contain a harmonic component appears as the frequency f. As a result, the circuitry of the AC power supply 105 for detection of the remaining amount of toner is configured such that the AC voltage 30 for detection of the remaining amount of toner to be output has a substantially sine waveform.

FIG. 16 is a block diagram showing an example of configuration of the AC power supply 105 for detection of the remaining amount of toner. Referring to FIG. 16, a voltage output from a voltage controlling unit 508 is converted into a square-wave voltage by an inverter unit 501. The square-wave voltage is converted into a substantially-sine-wave voltage by a band pass filter 502, and the substantially-sine wave voltage passes through a push-pull amplifier 503 and a high-voltage transformer 504 to generate the AC voltage 30 for detection of the remaining amount of toner having a substantially sine waveform. The voltage controlling unit 508 receives a signal that results from rectification of the AC voltage 30 for detection of the remaining amount of toner by a rectifier unit 505 and that is detected by a voltage detecting unit 506 and a signal supplied from a voltage setting unit 507. The voltage controlling unit 508 supplies a signal that generates the AC voltage 30 for detection of the remaining amount of toner having an amplitude based on the signal supplied from the voltage setting unit 507 to the inverter unit 501 to perform constant voltage control.

FIG. 17 is an exemplary circuit diagram of the AC power supply 105 for detection of the remaining amount of toner. Referring to FIG. 17, a clock signal CLK transmitted from the controller of an image forming apparatus (not shown) is supplied to the gate terminal of a field effect transistor (FET) 601 through a connection terminal 628, and an output voltage supplied from an operational amplifier 624 through a resistor 627 is converted into a square-wave voltage in response to the clock signal CLK. The square-wave voltage is converted into a substantially-sine-wave voltage by a low pass filter including resistors 602 and 603 and capacitors 604 and 605. The substantially-sine-wave voltage is supplied to a push-pull amplifier including resistors 606, 609, 612, and 613, diodes 607 and 608, and transistors 610 and 611. The direct-current (DC) component of the output from the push-pull amplifier is removed by an electrolytic capacitor 614, and the output from the electrolytic capacitor 614 subjected to the DC component removal is converted into the AC voltage 30 for detection of the remaining amount of toner having a substantially sine waveform by a high-voltage transformer 615. The AC voltage 30 for detection of the remaining amount of toner is rectified by capacitors 616 and 619 and diodes 617 and 618 and is supplied to the inverting input terminal of the operational amplifier 624 through resistors 620, 621, 622, and 623 as a detection signal. A voltage setting signal CONT_T transmitted from the controller of the image forming apparatus (not shown) is supplied to the non-inverting input terminal of the operational amplifier 624 through a connection terminal 629. The operational amplifier 624 supplies a signal that generates the AC voltage 30 for detection of the remaining amount of toner having an amplitude based on the voltage setting signal CONT_T to the FET 601 through an integration circuit including a resistor 625 and a capacitor 626 to perform the constant voltage control.

As described above, the AC power supply 105 for detection of the remaining amount of toner uses the band pass filter 502, the push-pull amplifier 503, the high-voltage transformer 504, etc. to generate the AC voltage 30 for detection of the remaining amount of toner having a substantially sine waveform in order to improve the precision of the detection of the remaining amount of toner. However, since it is necessary to provide the multiple circuit components in such a configuration of the power supply, it is difficult to reduce the size of the power supply. Furthermore, the provision of the high-voltage power supply for detection of the remaining amount of toner causes an increase of the cost of the image forming apparatus.

SUMMARY OF THE INVENTION

In order to resolve the above problems, the present invention provides a technology for generating an AC bias used for detection of the remaining amount of toner by an electrostatic-capacitance detection method in a smaller configuration and at a lower cost.

According to an embodiment of the present invention, an image forming apparatus includes an alternating-current power supply; a developer container containing a developer; a developer carrier that is provided in the developer container and that is configured to carry and convey the developer; an electrode member that opposes the developer carrier to form a pair of electrodes with the developer carrier; and a remaining-amount-of-developer detecting unit configured to apply an alternating-current voltage supplied from the alternating-current power supply to the developer carrier or one electrode of the pair of electrodes and to measure the difference in voltage between the other electrode of the pair of electrodes and the developer carrier or the one electrode of the pair of electrodes in order to detect the remaining amount of the developer in the developer container. The alternating-current power supply includes a piezoelectric transformer including a ceramic piezoelectric oscillation body; a piezoelectric-transformer driving unit configured to apply a driving voltage to a primary electrode of the piezoelectric transformer in order to excite the ceramic piezoelectric oscillating body; a piezoelectric-transformer driving-signal generating unit configured to apply a driving signal to the piezoelectric-transformer driving unit; a voltage detecting unit configured to detect an alternating-current voltage output from a secondary electrode of the piezoelectric transformer; a voltage setting unit configured to set a target value of the alternating-current voltage output from the secondary electrode of the piezoelectric transformer; and a controlling unit configured to feed back a difference signal between a detection signal supplied from the voltage detecting unit and a setting signal supplied from the voltage setting unit to the piezoelectric-transformer driving-signal generating unit to control the alternating-current voltage. The alternating-current voltage controlled with the controlling unit is applied to the developer carrier or the one electrode of the pair of electrodes to detect the remaining amount of the developer in the developer container.

According to another embodiment of the present invention, an image forming apparatus includes an image formation unit configured to form an image; a developer containing unit containing a developer; a developer carrier configured to carry and convey the developer in the developer containing unit; an electrode member facilitating detecting the remaining amount of the developer in the developer container; a power supply unit configured to output a voltage by using a piezoelectric transformer; and a remaining-amount detecting unit configured to apply an alternating-current voltage output from the power supply unit to the developer carrier or the electrode member to detect the remaining amount of the developer in the developer container. The power supply unit includes a direct-current voltage outputting unit configured to supply a direct-current voltage resulting from rectification of an alternating-current voltage output from the piezoelectric transformer to the image formation unit; an alternating-current voltage outputting unit configured to supply the alternating-current voltage output from the piezoelectric transformer to the developer carrier or the electrode member; and a setting unit configured to set the time when the direct-current voltage is output from the direct-current voltage outputting unit and the time when the alternating-current voltage is output from the alternating-current voltage outputting unit.

Further features of the present invention will become apparent from the following description of exemplary embodiments with reference to the attached drawings.

DESCRIPTION OF THE EMBODIMENTS

Exemplary embodiments of the present invention will herein be described in detail with reference to the attached drawings.

An image forming apparatus according to an exemplary embodiment of the present invention will be described in detail.

Figure 2:
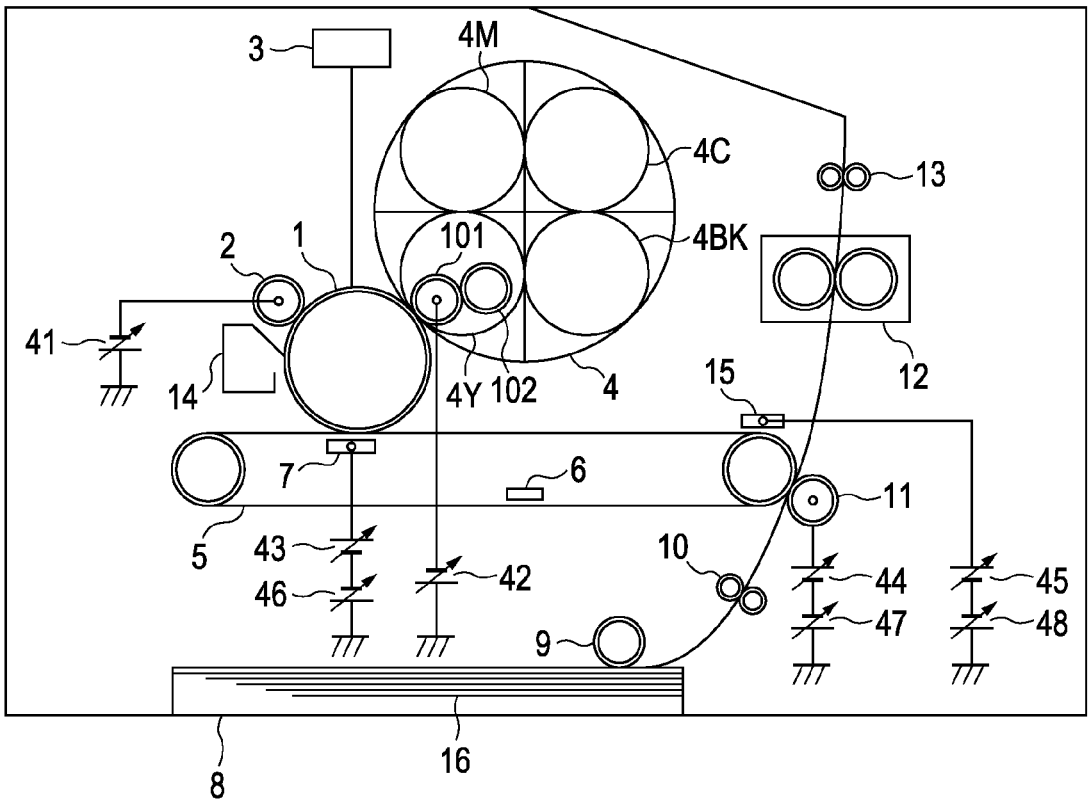
FIG. 2 schematically shows an example of the configuration of an image forming apparatus according to the first exemplary embodiment of the present invention.

FIG. 2 schematically shows an example of the configuration of the image forming apparatus using an electrophotographic process applicable to the embodiments of the present invention. In the exemplary embodiments of the present invention, toner is used as the developer, a toner container is the container of the developer, a developing roller 101 is a developer carrier, and a toner image is a developer image. The image forming apparatus includes a photosensitive drum 1 that is an image bearing member. When an image formation operation is started, a charging high-voltage power supply 41 applies a DC negative bias to a charging roller 2 serving as a charging unit to uniformly charge the surface of the photosensitive drum 1. Next, a top-of-page (TOP) sensor 6 detects the position where an image is started to be written, which is determined in consideration of the transfer position where a toner image on the photosensitive drum 1 is transferred on an intermediate transfer belt 5 serving as an intermediate transfer member. An exposure unit 3 performs exposure using a laser light modulated on the basis of an image signal on the surface of the photosensitive drum 1 in synchronization with a TOP signal, which is a reference signal supplied from the TOP sensor 6, to form an electrostatic latent image corresponding to the image signal of a first color on the photosensitive drum 1. A developer unit 4 includes developer portions 4Y, 4M, 4C, and 4BK containing yellow toner, magenta toner, cyan toner, and black toner, respectively. Rotation of the developer unit 4 at predetermined intervals causes the developer portions 4Y, 4M, 4C, and 4BK to be sequentially arranged at a developing position opposing the photosensitive drum 1. In order to develop the electrostatic latent image of the first color, the yellow developer portion 4Y opposes the photosensitive drum 1, and a developing high-voltage power supply 42 applies a DC negative bias to the developing roller 101 to visualize a toner image of the first color, that is, a yellow toner image and to form the yellow toner image on the photosensitive drum 1. Then, a primary transfer high-voltage power supply 43 applies a DC positive bias having the polarity opposite to that of the toner to a belt transfer member 7 provided at a position opposing the intermediate transfer belt 5 to primarily transfer the yellow toner image on the photosensitive drum 1 on the intermediate transfer belt 5 (this transfer is called primary transfer). The above process is repeated for the magenta developer portion 4M for the second color, the cyan developer portion 4C for the third color, and the black developer portion 4BK for the fourth color to form, for example, a full-color toner image on the intermediate transfer belt 5. Then, a paper feed roller 9 feeds a recording sheet of paper 16 loaded in a paper feed cassette 8 to a pair of registration rollers 10 at predetermined intervals based on the TOP signal and temporarily stops the recording sheet of paper 16 at the pair of registration rollers 10. The recording sheet of paper 16 is a recording medium. The pair of registration rollers 10 feeds the recording sheet of paper 16 again in synchronization with a predetermined transfer timing. A secondary transfer high-voltage power supply 44 applies a DC positive bias to a transfer roller 11 serving as a transfer unit to transfer the full-color toner image on the intermediate transfer belt 5 on the recording sheet of paper 16 (this transfer is called secondary transfer). A fuser unit 12 fuses the full-color toner image on the recording sheet of paper 16, which is not fixed, with heat and pressure to generate a permanent image. A pair of conveying rollers 13 ejects the recording sheet of paper 16 from the image forming apparatus. For example, the toner remaining on the photosensitive drum 1 after the primary transfer for every color on the intermediate transfer belt 5 is finished (hereinafter referred to as primary-transfer remaining toner) is removed from the photosensitive drum 1 and is collected in a remaining-toner collecting unit 14 composed of a blade-formed cleaning member. Similarly, the toner that is not transferred on the recording sheet of paper 16 and remains on the intermediate transfer belt 5 after the secondary transfer is finished (hereinafter referred to as secondary-transfer remaining toner) is positively charged with a DC positive bias applied from a belt-cleaning high-voltage power supply 45 to a belt cleaning unit 15 before the secondary-transfer remaining toner reaches the photosensitive drum 1. The negatively charged toner in the secondary-transfer remaining toner is collected by the belt cleaning unit 15. In contrast, the positively charged toner in the secondary-transfer remaining toner is electrostatically transferred on the photosensitive drum 1 by the primary transfer high-voltage power supply 43 that applies the positive bias having the same polarity as that of the secondary-transfer remaining toner and is removed from the photosensitive drum 1 to be collected in the remaining-toner collecting unit 14. Such belt cleaning that is immediately performed after the secondary transfer allows the image formation to be repetitively performed. The series of image forming operations described above is hereinafter referred to as an image formation sequence. The charging roller 2, the developing roller 101, the belt transfer member 7, the transfer roller 11, and the belt cleaning unit 15 are hereinafter collectively referred to an image formation member.

The transfer roller 11, the belt cleaning unit 15, and the belt transfer member 7 are electrostatic cleaning units and serve as a unit of electrostatically collecting the remaining developer. The remaining developer means the secondary-transfer remaining toner described above. A secondary-transfer reverse high-voltage power supply 47 and a belt-cleaning reverse high-voltage power supply 48 apply DC negative biases to the transfer roller 11 and the belt cleaning unit 15, respectively, at predetermined timing, for example, when the power supplies are turned on, after a predetermined number of copies are printed, or after jam is detected. In response to the DC negative biases, for example, the secondary-transfer remaining toner remaining on the transfer roller 11 or the belt cleaning unit 15 is negatively charged and is temporarily returned to the intermediate transfer belt 5. The secondary-transfer remaining toner that is negatively charged is electrostatically transferred on the photosensitive drum 1 by a primary-transfer reverse high-voltage power supply 46 that applies the negative bias having the same polarity as that of the secondary-transfer remaining toner and is removed from the photosensitive drum 1 to be collected in the remaining-toner collecting unit 14. The operation for removing and collecting the secondary-transfer remaining toner in the remaining-toner collecting unit 14 through the intermediate transfer belt 5 and the photosensitive drum 1 is hereinafter referred to as a cleaning sequence.

As described above, the image forming apparatus using the electrophotographic process is provided with the power supplies generating the DC biases in the individual processes. The "bias voltage" is also called the "bias" in this specification.

A first exemplary embodiment of the present invention is characterized in that a AC voltage output from a piezoelectric-transformer high-voltage power supply is applied to a developing unit to generate a AC bias for detection of the remaining amount of toner in a remaining-amount-of-toner detecting sequence by the electrostatic-capacitance detection method. A detailed configuration according to the first exemplary embodiment will now be described with reference to FIGS. 1 to 5. The same reference numerals are used in FIGS. 1 to 5 to identify the same components in the description of the related art described above. A description of such components is omitted herein.

Figure 1:
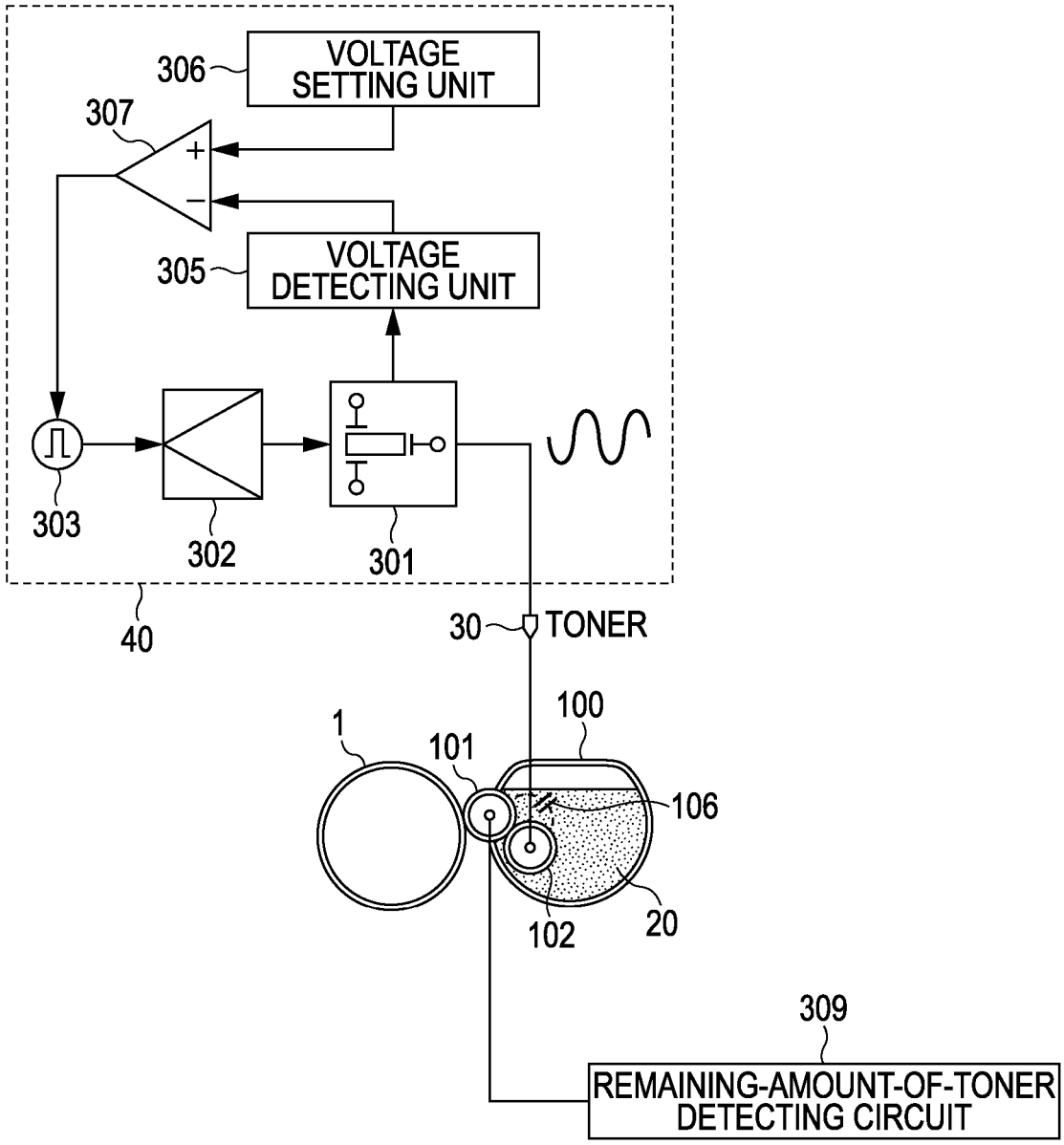
FIG. 1 is a block diagram showing an example of the configuration of an AC power supply for detection of the remaining amount of toner according to a first exemplary embodiment of the present invention.

FIG. 1 is a block diagram showing an example of the configuration of a remaining-amount-of-toner detecting mechanism according to the first exemplary embodiment of the present invention. In the first exemplary embodiment, the developing roller 101 is an electrode member and the RS roller 102 is an electrode member opposing the developing roller 101. The developing roller 101 and the RS roller 102 form a pair of counter electrodes. A piezoelectric-transformer high-voltage power supply 40 is an AC power supply that generates an AC voltage output from a piezoelectric transformer 301 as the AC voltage 30 for detection of the remaining amount of toner. The piezoelectric-transformer high-voltage power supply 40 applies the AC voltage to the RS roller 102. A remaining-amount-of-toner detecting circuit 309 is connected to the developing roller 101, and the AC voltage 30 for detection of the remaining amount of toner is applied to the RS roller 102. A voltage controlling unit 307 receives a detection level signal that indicates the excitation level of the piezoelectric transformer 301 and that is detected by a voltage detecting unit 305 and a setting level signal supplied from a voltage setting unit 306. The setting level signal is a signal having a predetermined excitation level (target excitation level) necessary to detect the remaining amount of toner from the piezoelectric transformer 301. The voltage controlling unit 307 supplies a difference signal based on the setting level signal to a piezoelectric-transformer driving-signal generating unit 303. A piezoelectric-transformer driving unit 302 drives the piezoelectric transformer 301 on the basis of a signal generated by the piezoelectric-transformer driving-signal generating unit 303. The AC voltage output from the piezoelectric transformer 301, that is, the AC voltage 30 for detection of the remaining amount of toner is applied to the developing roller 101 in the above manner. The use of the AC voltage 30 for detection of the remaining amount of toner allows the detection of the remaining amount of toner by the electrostatic-capacitance detection method described above in the related art to be realized. The remaining-amount-of-toner detecting circuit 309 compares the voltage level corresponding to a variation in the electrostatic capacitance of the equivalent capacitor 106 with a predetermined reference voltage level to detect the remaining amount of the toner 20 in the toner container 100.

Figure 3:
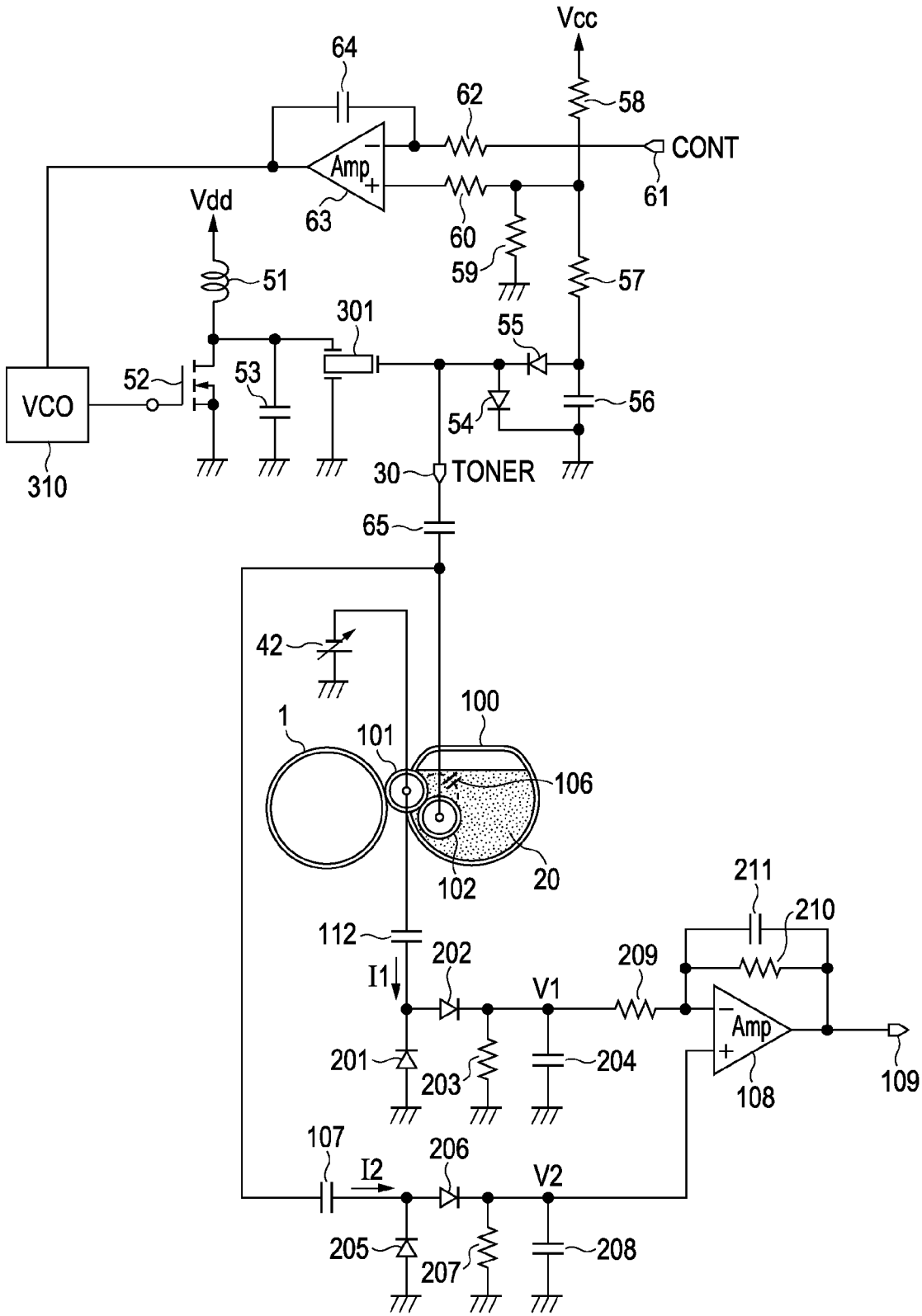
FIG. 3 is an exemplary circuit diagram of a remaining-amount-of-toner detecting mechanism according to the first exemplary embodiment of the present invention.

FIG. 3 is an exemplary circuit diagram of the remaining-amount-of-toner detecting mechanism adopting the electrostatic-capacitance detection method according to the first exemplary embodiment of the present invention. The piezoelectric transformer 301 is an element in which primary electrodes and a secondary electrode are formed on a ceramic piezoelectric oscillation body. The piezoelectric transformer 301 is resonated and driven by a driving circuit including an inductor 51, a FET 52, and a capacitor 53 to output an AC high voltage having a substantially sine waveform from its secondary electrode. The AC voltage output from the piezoelectric transformer 301 is rectified into a DC voltage by diodes 54 and 55 and a high-voltage capacitor 56. The rectified voltage is divided by resistors 57, 58, and 59, is converted into a signal having a predetermined level based on a DC power supply $V_{cc}$, and is supplied to the non-inverting input terminal of an operational amplifier 63 through a protective resistor 60. A control signal CONT, which is an analog signal, is supplied from the controller of an image forming apparatus (not shown) to the inverting input terminal of the operational amplifier 63 through a connection terminal 61 and a series resistor 62. The operational amplifier 63, the series resistor 62, and a capacitor 64 form an integration circuit. The output terminal of the operational amplifier 63 is connected a voltage controlled oscillator (VCO) 310 generating a piezoelectric-transformer driving signal, and the output terminal of the voltage controlled oscillator 310 is connected to the gate terminal of the FET 52. The voltage controlled oscillator 310 supplies a signal having a frequency corresponding to the level of the input voltage to the gate terminal of the FET 52.

Figure 4:
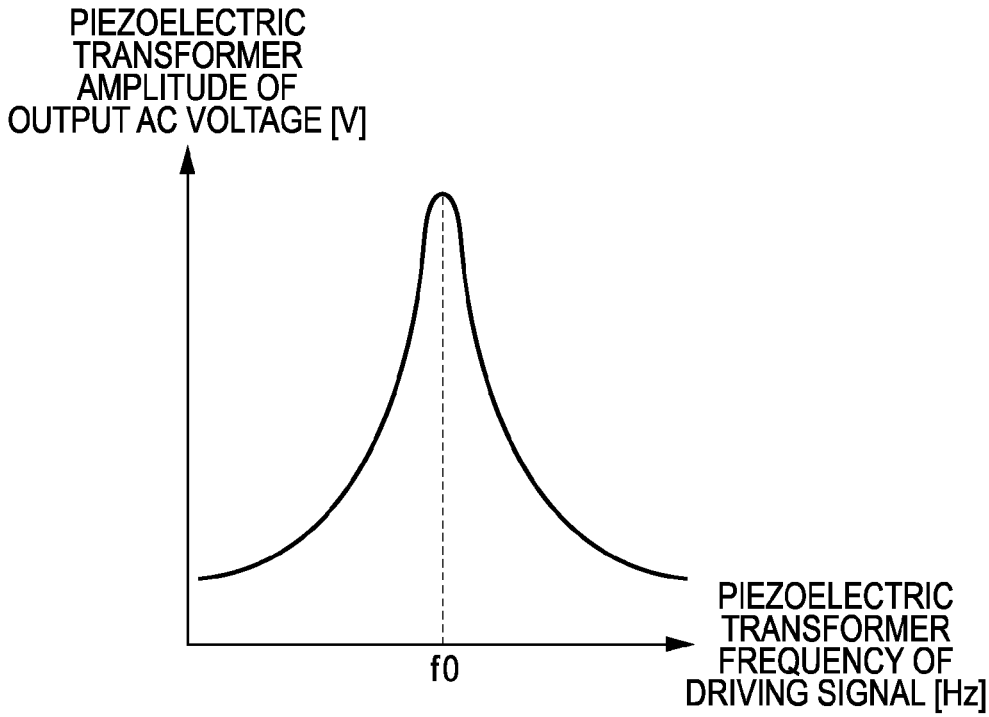
FIG. 4 is a graph showing frequency characteristics of a driving signal for a piezoelectric transformer according to the first exemplary embodiment of the present invention.
Figure 14:
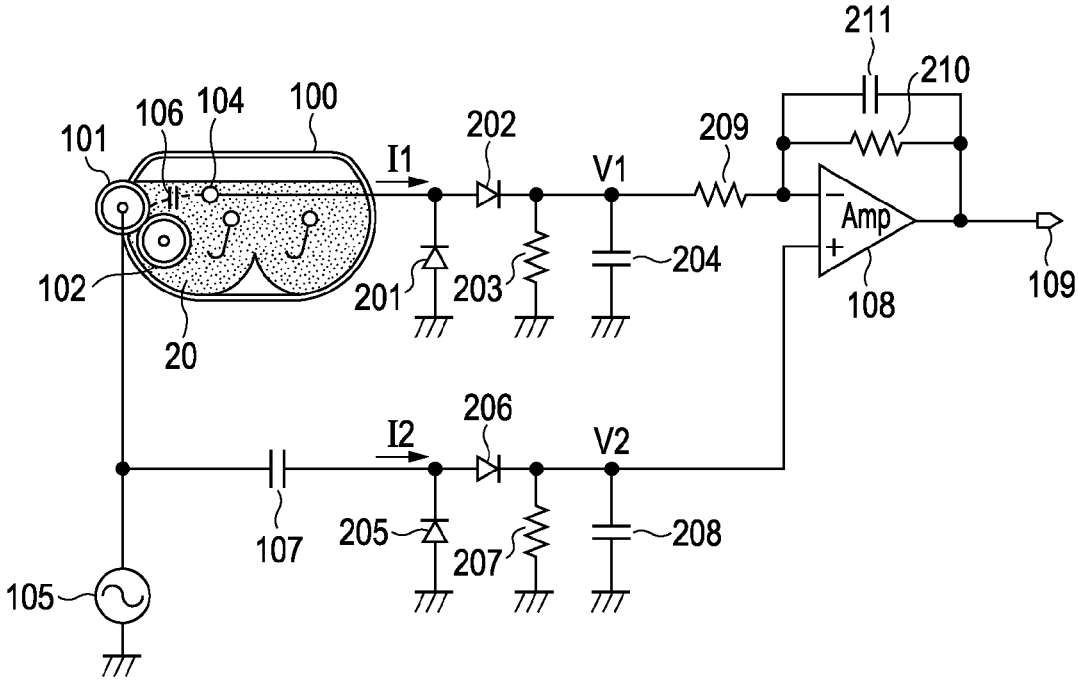
FIG. 14 is a circuit diagram of a remaining-amount-of-toner detecting mechanism adopting a method of detecting an electrostatic capacitance between a developing roller and an RS roller in related art.
Figure 15:
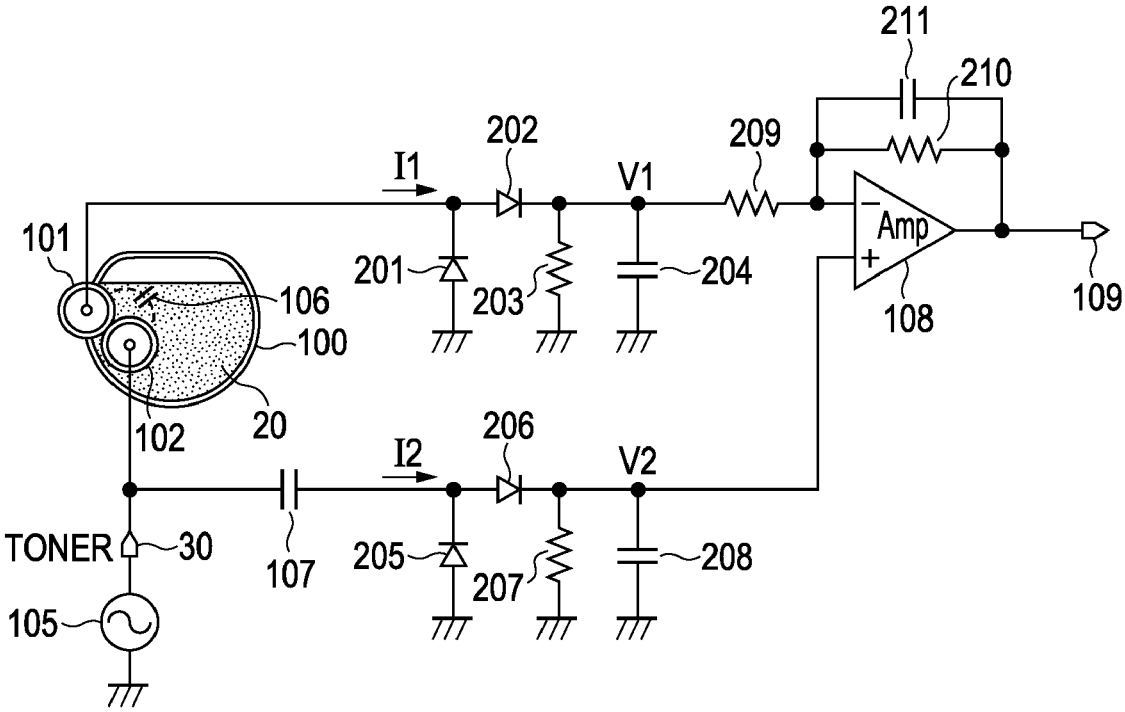
FIG. 15 is a circuit diagram of another remaining-amount-of-toner detecting mechanism adopting the method of detecting an electrostatic capacitance between a developing roller and an RS roller in the related art.
Figure 16:
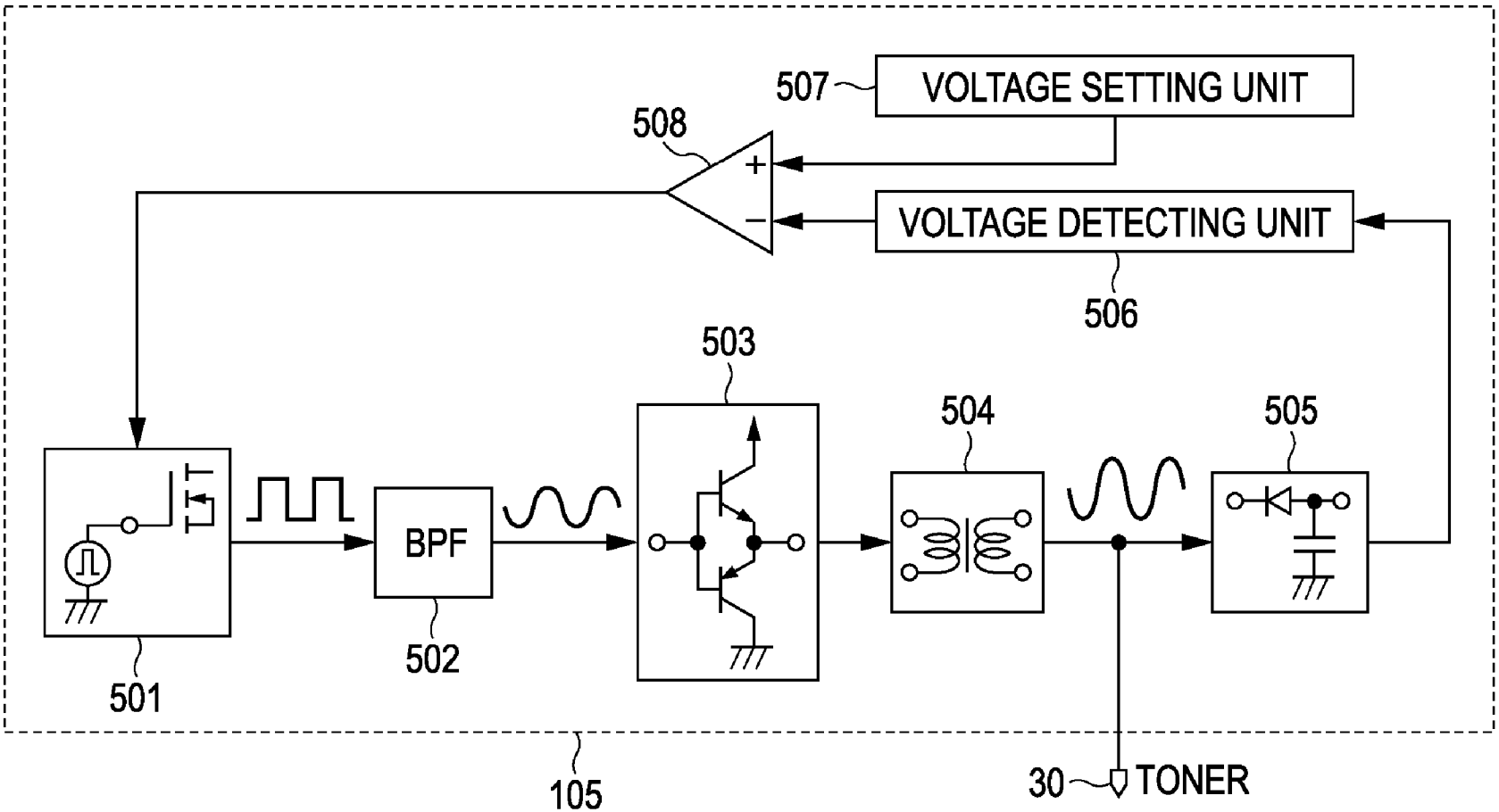
FIG. 16 is a block diagram showing an example of configuration of an AC power supply for detection of the remaining amount of toner in an image forming apparatus in the related art.
Figure 17:
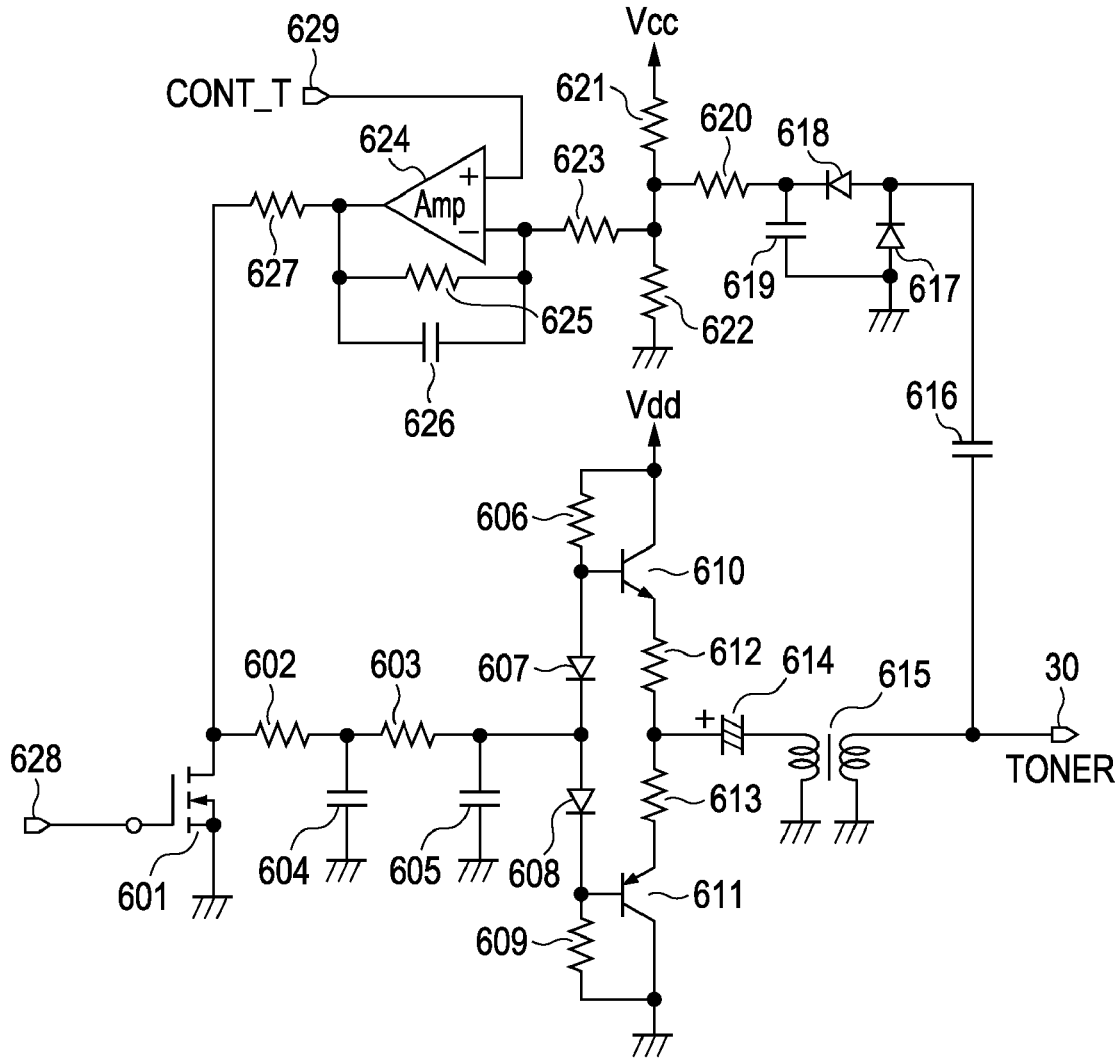
FIG. 17 is an exemplary circuit diagram of the AC power supply for detection of the remaining amount of toner in the image forming apparatus in the related art.

The drain terminal of the FET 52 is connected to a DC power supply $V_{dd}$ via the inductor 51, is grounded via the capacitor 53, and is connected to one of the primary electrodes of the piezoelectric transformer 301. The other one of the primary electrodes of the piezoelectric transformer 301 and the source terminal of the FET 52 are grounded. FIG. 4 is a graph showing the characteristics of an output voltage with respect to the frequency of a driving signal for the piezoelectric transformer 301. The graph in FIG. 4 shows that the maximum output voltage appears at a resonant frequency f0 and the output voltage can be controlled with the frequency for the driving signal. The antenna 104 shown in FIG. 14 may be used as the member that forms the pair of counter electrodes with the developing roller 101 and that opposes the developing roller 101, instead of the RS roller 102.

Figure 5:
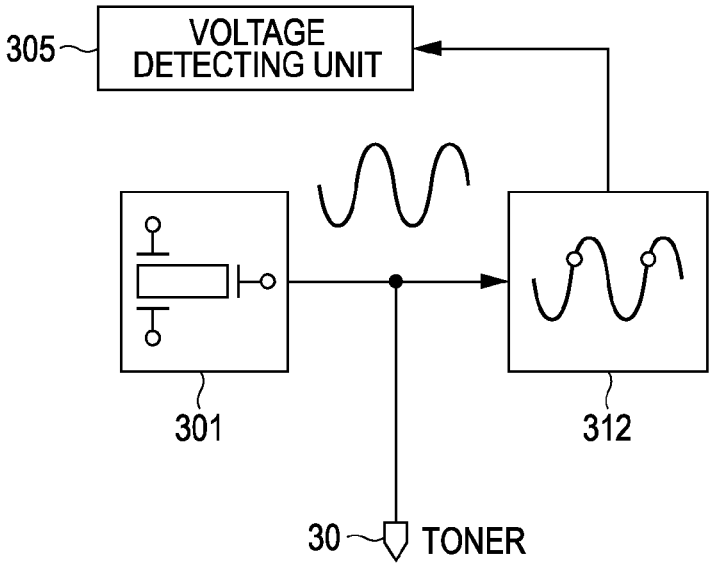
FIG. 5 is a block diagram showing an example of the configuration of a voltage detecting unit according to the first exemplary embodiment of the present invention.

As described above, the control of the driving frequency of the piezoelectric transformer 301 by using the negative feedback control by the voltage controlled oscillator 310 and the operational amplifier 63 realizes the high-voltage power supply performing the constant voltage control of the output AC voltage. In this case, the voltage output from the piezoelectric transformer 301 having sharp impedance characteristic can be stabilized by the feedback control and the filter characteristics of the piezoelectric transformer 301 can be used to generate the output voltage having a sine waveform. In this configuration, the rectifier circuit including the diodes 54 and 55 and the high-voltage capacitor 56 is used as the unit of detecting the excitation level of the piezoelectric transformer 301 and the rectifier circuit converts the AC voltage output from the piezoelectric transformer 301 into a DC voltage that is detected. The rectifier circuit is an example of the unit of detecting the excitation level of the piezoelectric transformer 301 and may be replaced with another unit capable of detecting resonance information about the piezoelectric transformer 301. For example, as shown in FIG. 5, a phase-synchronization detecting unit 312 that samples the AC voltage output from the piezoelectric transformer 301 at a predetermined phase based on the driving timing may be used to detect the excitation level of the piezoelectric transformer 301. Alternatively, another configuration may be used to detect information including the effective value of the AC voltage output from the piezoelectric transformer 301, the average value thereof, and/or the peak hold value thereof.

The AC voltage output from the piezoelectric-transformer high-voltage power supply, that is, the AC voltage 30 for detection of the remaining amount of toner is applied to the RS roller 102 through a coupling capacitor 65 for removal of the DC voltage component of the AC voltage 30 for detection of the remaining amount of toner. As described above in the related art, the difference in voltage between the RS roller 102 and the developing roller 101 is measured and a variation in the electrostatic capacitance of the equivalent capacitor 106 provided between the RS roller 102 and the developing roller 101 is detected to detect the remaining amount of the toner 20 in the toner container 100. A coupling capacitor 112 is used to remove the DC voltage component so that the DC negative bias applied to the developing roller 101 by the developing high-voltage power supply 42 is not applied to the side of the remaining-amount-of-toner detecting circuit.

Since the piezoelectric transformer 301 in the piezoelectric-transformer high-voltage power supply 40 is a resonant body, the piezoelectric transformer 301 has the function of a band-pass filter. Accordingly, it is possible to generate the substantially-sine-wave voltage without adding, for example, an external filter for waveform shaping. In addition, the piezoelectric-transformer high-voltage power supply 40 performs the constant voltage control to the output AC voltage by using the frequency of the driving signal for the piezoelectric transformer 301, and the frequency of the signal used for driving the piezoelectric-transformer driving unit 302 is constantly varied. The rectifier circuit that rectifies the AC current $I_1$ and the AC current $I_2$ in FIG. 3 to convert the AC current $I_1$ and the AC current $I_2$ into the voltage $V_1$ and the reference voltage $V_2$, respectively, has frequency characteristics. Accordingly, the voltage $V_1$ and the reference voltage $V_2$ can be varied in accordance with the frequency of the driving signal for the piezoelectric transformer 301. However, when the piezoelectric transformer 301 is driven around the frequency of the driving signal, for example, around 150 kHz, the variation in the frequency of the driving signal is about ±1% to 2% with respect to a target output voltage. Accordingly, the variation in the voltage $V_1$ and the reference voltage $V_2$ due to the frequency characteristics of the rectifier circuit is very small and, therefore, the precision of the detection of the remaining amount of the toner is not degraded because of the variation.

As described above, according to the first exemplary embodiment of the present invention, with the above configuration, it is possible to simply generate the AC bias for detection of the remaining amount of toner by the electrostatic-capacitance detection method requiring the higher-precision detection at a lower cost.

Figure 6:
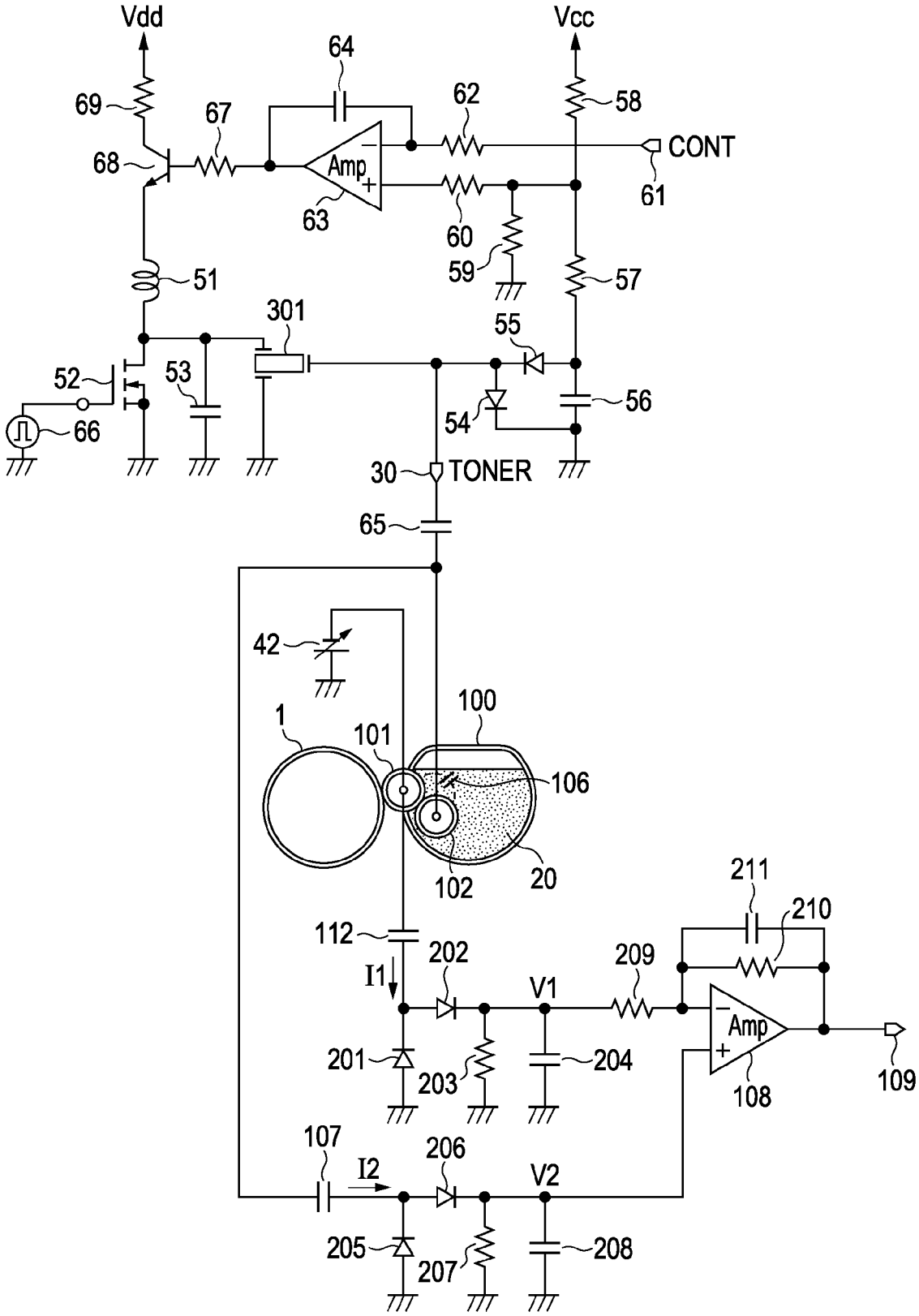
FIG. 6 is an exemplary circuit diagram of a remaining-amount-of-toner detecting mechanism according to a second exemplary embodiment of the present invention.

A second exemplary embodiment of the present invention will now be described with reference to FIG. 6. The same reference numerals are used in FIG. 6 to identify the same components in the description of the related art and the above exemplary embodiments. A description of such components is omitted herein. FIG. 6 is an exemplary circuit diagram of a remaining-amount-of-toner detecting mechanism adopting the electrostatic-capacitance detection method according to the second exemplary embodiment of the present invention. The remaining-amount-of-toner detecting mechanism in FIG. 6 differs from the remaining-amount-of-toner detecting mechanism in FIG. 3 in that the remaining-amount-of-toner detecting mechanism in FIG. 6 includes a clock generator 66 generating a driving signal having a fixed frequency, instead of the voltage controlled oscillator (VCO) 310. In addition, in the remaining-amount-of-toner detecting mechanism in FIG. 6, the operational amplifier 63, resistors 67 and 69, and a transistor 68 are used to control the amplitude of a driving voltage applied to the primary electrodes of the piezoelectric transformer 301. The output terminal of the operational amplifier 63 is connected to the base terminal of the transistor 68 through the resistor 67. The drain terminal of the FET 52 is connected to the DC power supply $V_{dd}$ via the inductor 51, the transistor 68, and the resistor 69. The clock generator 66 is connected to the gate terminal of the FET 52. The base current of the transistor 68 is varied in accordance with the level of the voltage output from the operational amplifier 63 to control the amplitude of the driving voltage applied to the primary electrodes of the piezoelectric transformer 301. The control of the amplitude of the driving voltage applied to the primary electrodes of the piezoelectric transformer 301 by using the negative feedback control by the clock generator 66, the operational amplifier 63, the resistors 67 and 69, and the transistor 68 in the above manner realizes the high-voltage power supply performing the constant voltage control of the output AC voltage. The amplitude of the driving voltage applied to the primary electrodes of the piezoelectric transformer 301 may be controlled by another method. For example, a method of feeding back a control voltage supplied from the operational amplifier 63 to the clock generator 66 to control the duty ratio of the driving signal generated by the clock generator 66 may be used. In the control of the amplitude of the driving voltage applied to the primary electrodes of the piezoelectric transformer 301 by the above method, the voltage output from the piezoelectric transformer 301 having sharp impedance characteristics can be stabilized by the feedback control. In other words, the filter characteristics of the piezoelectric transformer 301 can be used to generate the sine-wave output voltage at the secondary electrode. As in the configuration according to the first exemplary embodiment, another configuration may be used to detect the excitation level of the piezoelectric transformer 301. In addition, the antenna 104 shown in FIG. 14 may be used as the member that forms the pair of counter electrodes with the developing roller 101 and that opposes the developing roller 101, instead of the RS roller 102.

As described above, according to the second exemplary embodiment of the present invention, with the above configuration, it is possible to simply generate the AC bias for detection of the remaining amount of toner by the electrostatic-capacitance detection method requiring the higher-precision detection at a lower cost.

A third exemplary embodiment of the present invention will now be described with reference to FIGS. 7 and 8. The same reference numerals are used in FIGS. 7 and 8 to identify the same components in the description of the related art and the above exemplary embodiments. A description of such components is omitted herein.

Figure 7:
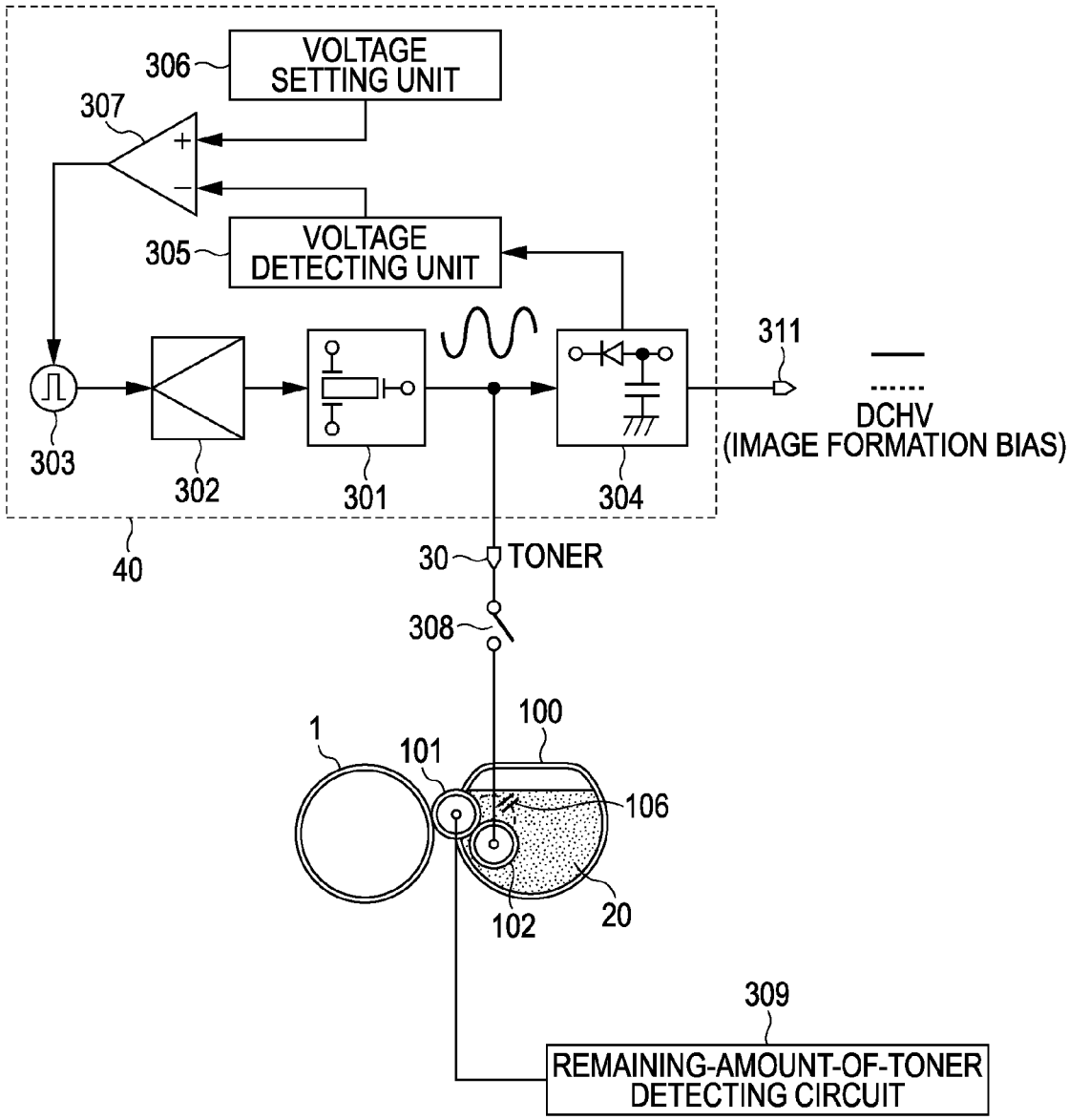
FIG. 7 is a block diagram showing an example of the configuration of a remaining-amount-of-toner detecting mechanism according to a third exemplary embodiment of the present invention.

FIG. 7 is a block diagram showing an example of the configuration of a remaining-amount-of-toner detecting mechanism according to the third exemplary embodiment of the present invention. The remaining-amount-of-toner detecting mechanism in FIG. 7 differs from the remaining-amount-of-toner detecting mechanism in FIG. 1 in that the piezoelectric-transformer high-voltage power supply 40 also serves as a DC power supply generating at least one DC bias 311 to be applied to the image formation member and in that the remaining-amount-of-toner detecting mechanism in FIG. 7 includes a switch 308. The switch 308 is used to select the application of the AC voltage output from the piezoelectric-transformer high-voltage power supply 40 to the electrode for detection of the remaining amount of toner. Specifically, the AC voltage 30 for detection of the remaining amount of toner is rectified by a rectifying unit 304 to be used as the DC bias and is also used to detect the excitation level of the piezoelectric transformer 301. The DC biases 311 include DC biases for the charging, the developing, the primary transfer, the secondary transfer, and the belt-cleaning (hereinafter referred to as image formation biases). If at least one of the image formation biases is generated from the voltage resulting from the rectification of the AC voltage output from the piezoelectric-transformer high-voltage power supply 40, the AC voltage can be applied to the developing roller 101 or the RS roller 102 in the image formation sequence to possibly cause poor developing. Accordingly, it is necessary to provide a mechanism to prevent the AC voltage from being applied to the developing roller 101 or the RS roller 102 in the image formation sequence. In order to realize the provision of this mechanism, the switch 308 is turned off in the image formation sequence and is turned on in the detection of the remaining amount of toner other than in the image formation sequence. The AC voltage 30 for detection of the remaining amount of toner is applied to the RS roller 102 only when the switch 308 is turned on.

Figure 8:
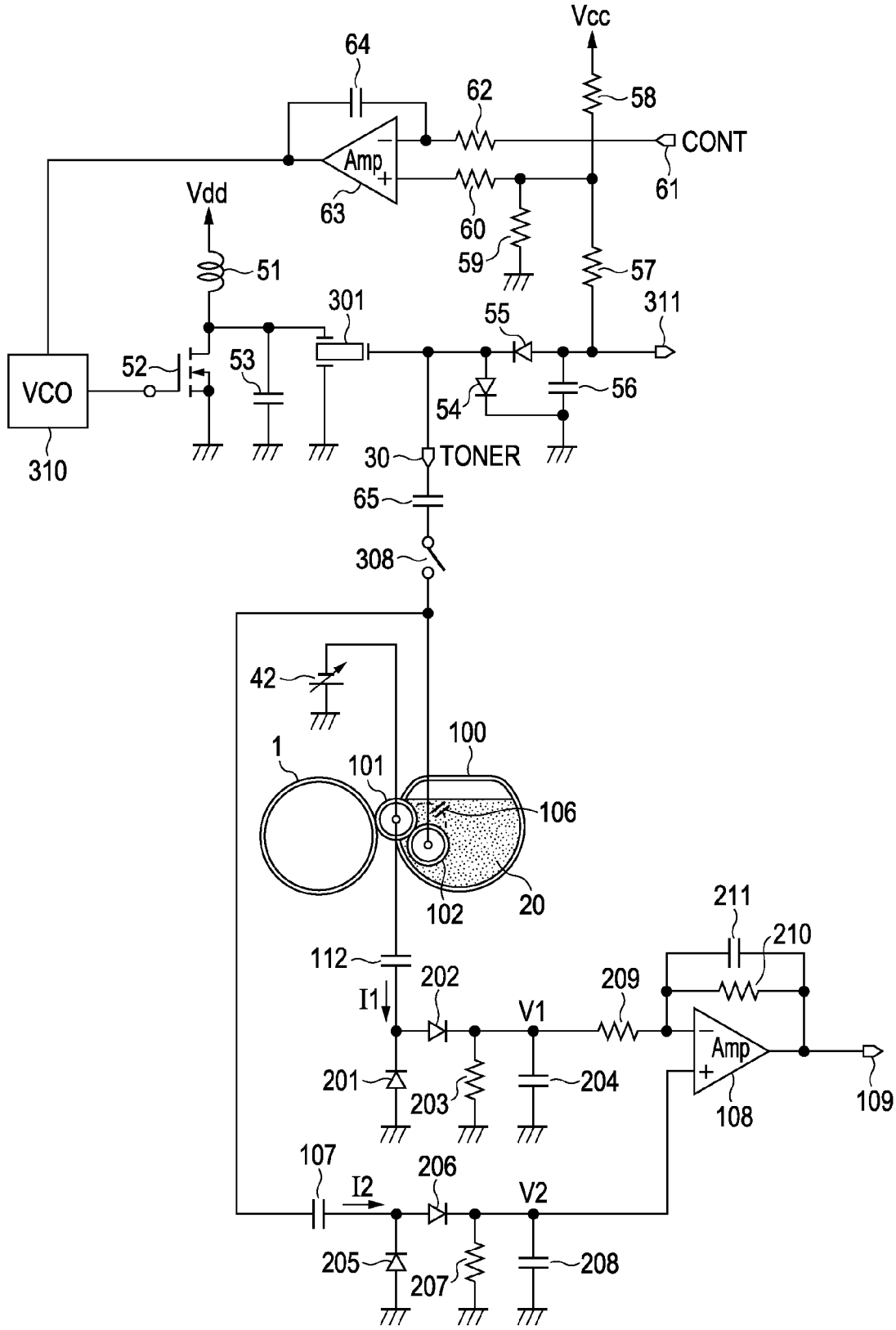
FIG. 8 is an exemplary circuit diagram of the remaining-amount-of-toner detecting mechanism according to the third exemplary embodiment of the present invention.

FIG. 8 is an exemplary circuit diagram of the remaining-amount-of-toner detecting mechanism according to the third exemplary embodiment of the present invention. The piezoelectric-transformer high-voltage power supply in FIG. 8 is a typical power supply adopting the method in which the voltage controlled oscillator 310 is used to control the frequency of the driving signal for the piezoelectric transformer 301, described above in the first exemplary embodiment. The piezoelectric-transformer high-voltage power supply in FIG. 8 may be replaced with the power supply adopting the method in which the amplitude of the driving voltage applied to the primary electrodes of the piezoelectric transformer 301 is controlled, described above in the second exemplary embodiment. The DC bias 311 in FIG. 8 is a DC negative bias and is used as, for example, the DC bias for the charging or the developing. The DC bias 311 in FIG. 8 may be a DC positive bias resulting from switching of the polarities of the diodes 54 and 55 and may be used as, for example, the DC bias for the primary transfer, the secondary transfer, or the belt-cleaning. Referring to FIG. 8, as described above in the related art, a variation in the electrostatic capacitance of the equivalent capacitor 106 formed between the RS roller 102 and the developing roller 101 is detected to detect the remaining amount of the 320 in the toner container 100. The antenna 104 shown in FIG. 14 may be used as the member that forms the pair of counter electrodes with the developing roller 101 and that opposes the developing roller 101, instead of the RS roller 102.

As described above, according to the third exemplary embodiment of the present invention, at least one DC bias 311 is generated from the AC voltage output from the piezoelectric-transformer high-voltage power supply 40, that is, from the voltage resulting from the rectification of the AC voltage 30 for detection of the remaining amount of toner. With the above configuration, it is possible to reduce the cost of the power supply units because there is no need to provide the DC power supplies generating the image formation biases used for, for example, the charging and the developing.

A fourth exemplary embodiment of the present invention will now be described with reference to FIGS. 9 and 10. The same reference numerals are used in FIGS. 9 and 10 to identify the same components in the description of the related art and the above exemplary embodiments. A description of such components is omitted herein.

Figure 9:
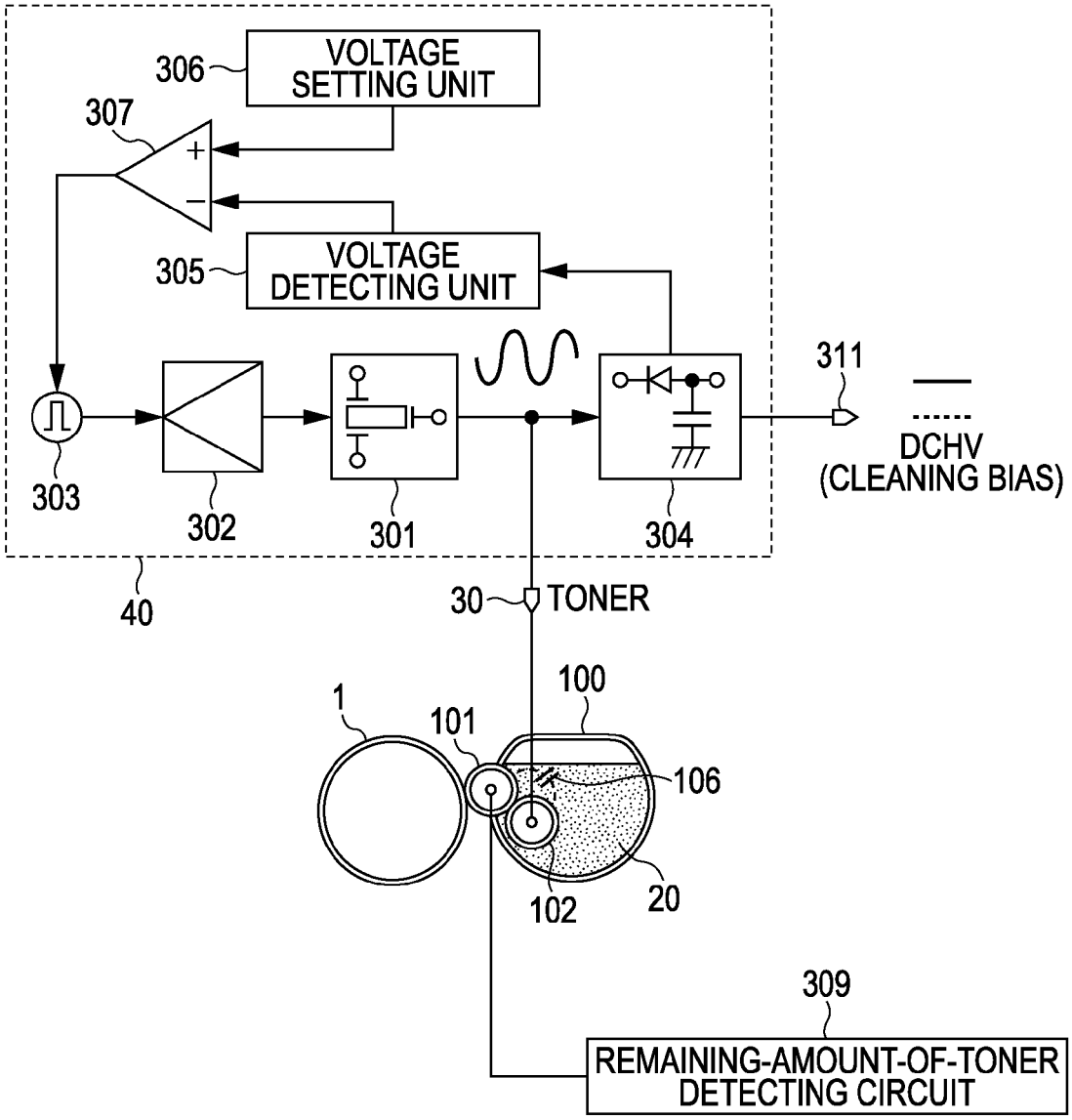
FIG. 9 is a block diagram showing an example of the configuration of a remaining-amount-of-toner detecting mechanism according to a fourth exemplary embodiment of the present invention.

FIG. 9 is a block diagram showing an example of the configuration of a remaining-amount-of-toner detecting mechanism according to the fourth exemplary embodiment of the present invention. The remaining-amount-of-toner detecting mechanism in FIG. 9 differs from the remaining-amount-of-toner detecting mechanism in FIG. 1 in that the piezoelectric-transformer high-voltage power supply 40 also serves as a DC power supply generating at least one DC bias 311 to be applied to the electrostatic cleaning unit. Specifically, the AC voltage 30 for detection of the remaining amount of toner is rectified by the rectifying unit 304 to be used as the DC bias and is also used to detect the excitation level of the piezoelectric transformer 301. The DC biases 311 include DC biases for the reversal for the primary transfer, the secondary transfer, and the belt-cleaning (hereinafter referred to as cleaning biases). If at least one of the cleaning biases is generated from the voltage resulting from the rectification of the AC voltage output from the piezoelectric-transformer high-voltage power supply 40, no AC voltage is applied to the developing roller 101 or the RS roller 102 in the image formation sequence. Accordingly, there is no need to provide the switch 308 described above in the second exemplary embodiment and there is no need to provide the mechanism to prevent the AC voltage from being applied to the developing roller 101 or the RS roller 102 in the image formation sequence.

Figure 10:
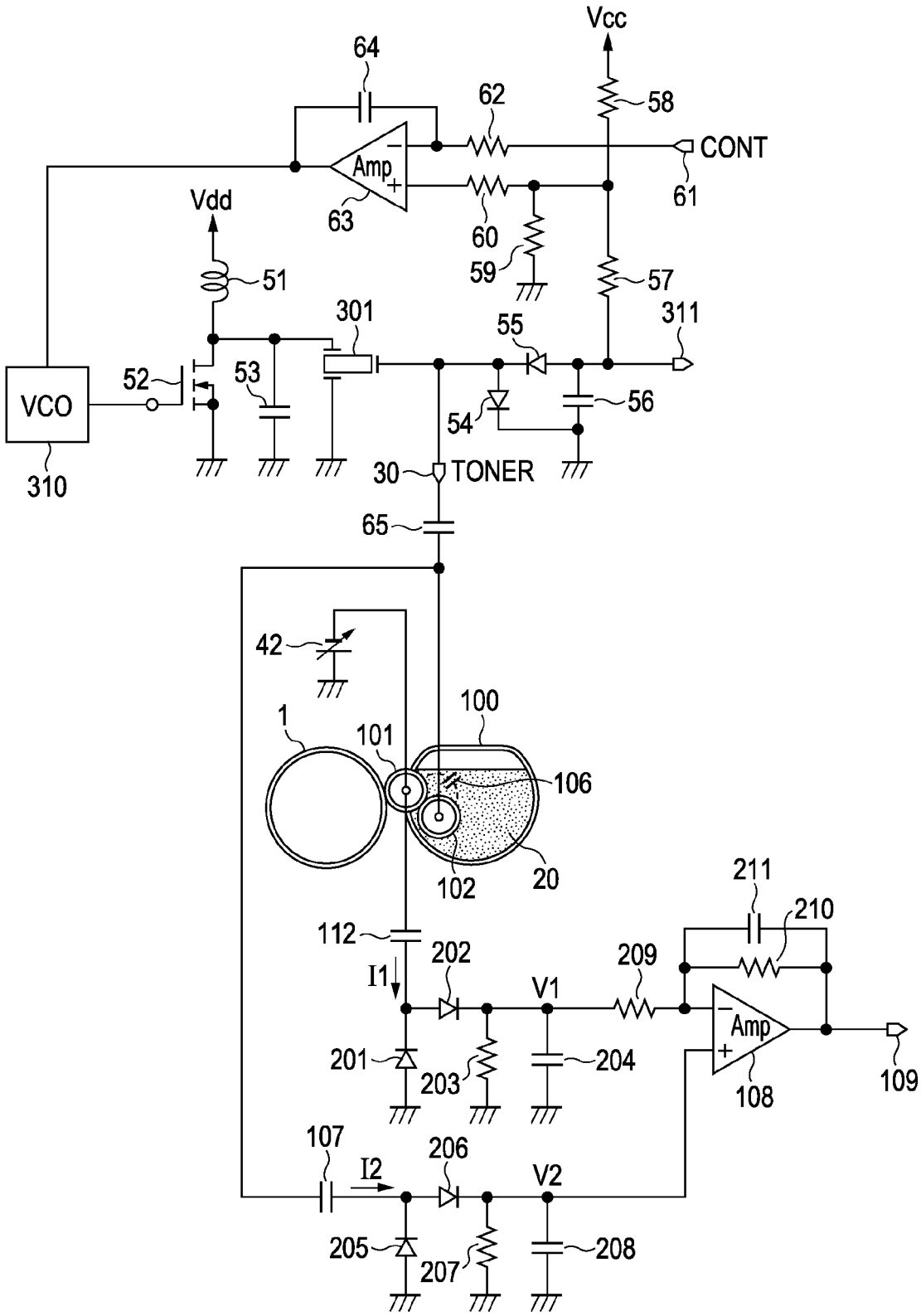
FIG. 10 is an exemplary circuit diagram of the remaining-amount-of-toner detecting mechanism according to the fourth exemplary embodiment of the present invention.

FIG. 10 is an exemplary circuit diagram of the remaining-amount-of-toner detecting mechanism according to the fourth exemplary embodiment of the present invention. The piezoelectric-transformer high-voltage power supply in FIG.

10 is a typical power supply adopting the method in which the voltage controlled oscillator 310 is used to control the frequency of the driving signal for the piezoelectric transformer 301, described above in the first exemplary embodiment. The piezoelectric-transformer high-voltage power supply in FIG. 10 may be replaced with the power supply adopting the method in which the amplitude of the driving voltage applied to the primary electrodes of the piezoelectric transformer 301 is controlled, described above in the second exemplary embodiment. The DC bias 311 in FIG. 10 is a DC negative bias and is used as, for example, the DC bias for the reversal for the primary transfer, the secondary transfer, or the belt-cleaning. Referring to FIG. 10, as described above in the related art, a variation in the electrostatic capacitance of the equivalent capacitor 106 formed between the RS roller 102 and the developing roller 101 is detected to detect the remaining amount of the 320 in the toner container 100. The antenna 104 shown in FIG. 14 may be used as the member that forms the pair of counter electrodes with the developing roller 101 and that opposes the developing roller 101, instead of the RS roller 102.

As described above, according to the fourth exemplary embodiment of the present invention, at least one DC bias 311 is generated from the AC voltage output from the piezoelectric-transformer high-voltage power supply 40, that is, from the voltage resulting from the rectification of the AC voltage 30 for detection of the remaining amount of toner. With the above configuration, there is no need to provide the power supplies generating the cleaning biases for the reversal for the primary transfer, the secondary transfer, and the belt-cleaning. In addition, since there is no need to provide the switch in the third exemplary embodiment, it is possible to further reduce the cost of the power supply units.

A fifth exemplary embodiment of the present invention will now be described with reference to FIGS. 11 and 12. The same reference numerals are used in FIGS. 11 and 12 to identify the same components in the description of the related art and the above exemplary embodiments. A description of such components is omitted herein.

The fifth exemplary embodiment of the present invention is characterized in that the AC bias for detection of the remaining amount of toner is applied in synchronization with the cleaning sequence in the fourth exemplary embodiment described above.

Figure 11:
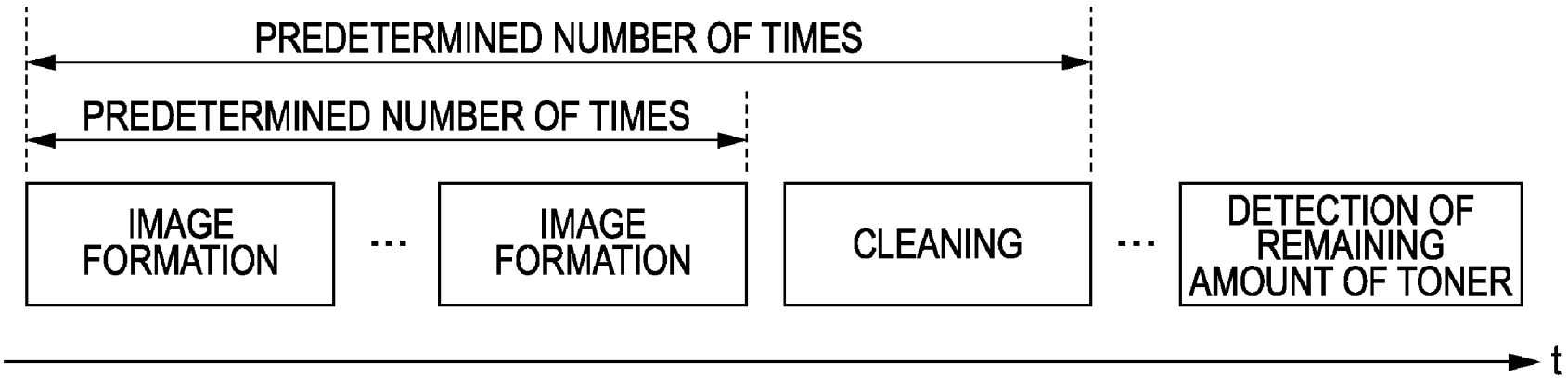
FIG. 11 illustrates an operational sequence of an image forming apparatus in the related art.
Figure 12:
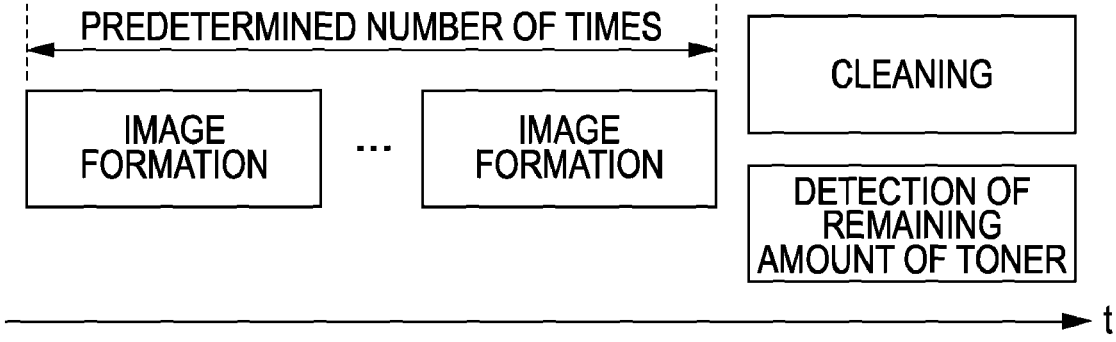
FIG. 12 illustrates an operational sequence of an image forming apparatus according to a fifth embodiment of the present invention.

FIG. 11 illustrates an operational sequence of an image forming apparatus in the related art. As shown in FIG. 11, the cleaning is performed after the image formation is performed a predetermined number of times and the detection of the remaining amount of toner is performed after the sequence including the image formation and the cleaning is performed a predetermined number of times in the related art. In contrast, in an operational sequence of the image forming apparatus according to the fifth exemplary embodiment shown in FIG. 12, the cleaning and the detection of the remaining amount of toner can be concurrently performed because the voltage resulting from the rectification of the AC voltage output from the piezoelectric-transformer high-voltage power supply 40 is used as the DC bias 311. Accordingly, it is possible to reduce the time necessary for the operational sequence because there is no need to independently provide the sequence of the detection of the remaining amount of toner.

As described above, it is possible to reduce the time necessary for the detection of the remaining amount of toner by using the voltage resulting from the rectification of the AC voltage output from the piezoelectric-transformer high-voltage power supply 40 as the DC bias 311 and applying the AC bias for the detection of the remaining amount of toner in synchronization with the cleaning sequence.

A sixth exemplary embodiment of the present invention will now be described with reference to FIG. 13. The same reference numerals are used in FIG. 13 to identify the same components in the description of the related art and the above exemplary embodiments. A description of such components is omitted herein.

The sixth exemplary embodiment of the present invention is characterized in that the AC bias for detection of the remaining amount of toner is applied not only to the RS roller 102 but also to the developing roller 101 or the antenna 104. The sixth exemplary embodiment differs from the above exemplary embodiments only in this point.

Figure 13:
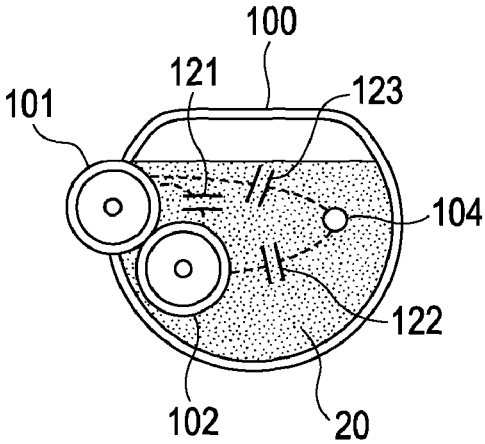
FIG. 13 schematically shows an example of the configuration of a developing unit according to a sixth exemplary embodiment of the present invention.

FIG. 13 schematically shows an example of the configuration of a developing unit according to the sixth exemplary embodiment of the present invention. The AC voltage 30 for detection of the remaining amount of toner may be applied to any component that forms a pair of electrodes in the toner container 100 as long as the electrostatic capacitance of the equivalent capacitor formed between the component and the other component in the pair of electrodes is decreased in accordance with a variation in the remaining amount the toner 20 in the toner container 100. Specifically, the AC voltage 30 for detection of the remaining amount of toner may be applied to any of the developing roller 101, the RS roller 102, and the antenna 104. Specifically, a variation in the electrostatic capacitance of an equivalent capacitor 121 between the developing roller 101 and the RS roller 102, an equivalent capacitor 122 between the RS roller 102 and the antenna 104, or an equivalent capacitor 123 between the developing roller 101 and the antenna 104 may be detected. In order to precisely detect the remaining amount of toner, the AC voltage 30 for detection of the remaining amount of toner is preferably applied to the RS roller 102 or the antenna 104.

With the above configuration, it is possible to improve the flexibility of the remaining-amount-of-toner detecting mechanism adopting the electrostatic-capacitance detection method.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-096093 filed Apr. 2, 2008, which is hereby incorporated by reference herein in its entirety.

What is claimed is:

1. An image forming apparatus comprising:

an alternating-current power supply;

a developer container containing a developer;

a developer carrier that is provided in the developer container and that is configured to carry and convey the developer;

an electrode member that opposes the developer carrier to form a pair of electrodes with the developer carrier; and a remaining-amount-of-developer detecting unit configured to apply an alternating-current voltage supplied from the alternating-current power supply to the developer carrier or one electrode of the pair of electrodes and to measure the difference in voltage between the other electrode of the pair of electrodes and the developer carrier or the one electrode of the pair of electrodes in order to detect the remaining amount of the developer in the developer container, wherein the alternating-current power supply includes:

a piezoelectric transformer including a ceramic piezoelectric oscillation body;

a piezoelectric-transformer driving unit configured to apply a driving voltage to a primary electrode of the piezoelectric transformer in order to excite the ceramic piezoelectric oscillating body;

a piezoelectric-transformer driving-signal generating unit configured to apply a driving signal to the piezoelectric-transformer driving unit;

a voltage detecting unit configured to detect an alternating-current voltage output from a secondary electrode of the piezoelectric transformer;

a voltage setting unit configured to set a target value of the alternating-current voltage output from the secondary electrode of the piezoelectric transformer; and a controlling unit configured to feed back a difference signal between a detection signal supplied from the voltage detecting unit and a setting signal supplied from the voltage setting unit to the piezoelectric-transformer driving-signal generating unit to control the alternating-current voltage, and wherein the alternating-current voltage controlled with the controlling unit is applied to the developer carrier or the one electrode of the pair of electrodes to detect the remaining amount of the developer in the developer container.

2. The image forming apparatus according to claim 1, wherein the piezoelectric-transformer driving-signal generating unit adjusts the frequency of the driving signal for the piezoelectric transformer in accordance with the difference signal.

3. The image forming apparatus according to claim 1, wherein the piezoelectric-transformer driving-signal generating unit controls the amplitude of the driving voltage to be applied to the primary electrode of the piezoelectric transformer in accordance with the difference signal.

4. The image forming apparatus according to claim 1, wherein the voltage detecting unit includes a rectifying unit configured to rectify the alternating-current voltage output from the secondary electrode of the piezoelectric transformer, and detects a rectification voltage resulting from the rectification by the rectifying unit.

5. The image forming apparatus according to claim 4, wherein the rectification voltage is supplied to an image formation member as a direct-current voltage, and the alternating-current voltage is applied to either electrode of the pair of electrodes during a period during which no direct-current voltage is applied to the image formation member.

6. The image forming apparatus according to claim 4, further comprising:

an intermediate transfer member carrying an image formed by the developer, wherein the rectification voltage is applied to a cleaning unit configured to collect the developer remaining on the intermediate transfer member, and wherein the alternating-current voltage is applied to the developer carrier or the one electrode of the pair of electrodes in synchronization with the application of the rectification voltage to the cleaning unit.

7. The image forming apparatus according to claim 6, wherein an alternating-current bias supplied from the alternating-current power supply is applied to the developer carrier or either electrode of the pair of electrodes in synchronization with the collection operation of the cleaning unit.

8. The image forming apparatus according to claim 1, wherein the electrode member is a conductor including a dielectric body that is in contact with the developer carrier to supply the developer or a conductor that is provided away from the developer carrier by a predetermined distance.

9. An image forming apparatus comprising:

an image formation unit configured to form an image;

a developer containing unit containing a developer;

a developer carrier configured to carry and convey the developer in the developer containing unit;

an electrode member facilitating detecting the remaining amount of the developer in the developer containing unit;

a power supply unit configured to output a voltage by using a piezoelectric transformer; and a remaining-amount detecting unit configured to apply an alternating-current voltage output from the power supply unit to the developer carrier or the electrode member to detect the remaining amount of the developer in the developer containing unit, wherein the power supply unit includes:

a direct-current voltage outputting unit configured to supply a direct-current voltage resulting from rectification of an alternating-current voltage output from the piezoelectric transformer to the image formation unit;

an alternating-current voltage outputting unit configured to supply the alternating-current voltage output from the piezoelectric transformer to the developer carrier or the electrode member; and a setting unit configured to set the time when the direct-current voltage is output from the direct-current voltage outputting unit and the time when the alternating-current voltage is output from the alternating-current voltage outputting unit.

10. The image forming apparatus according to claim 9, wherein the setting unit is a switch used for shifting the time when the direct-current voltage is output from the direct-current voltage outputting unit from the time when the alternating-current voltage is output from the alternating-current voltage outputting unit.

11. The image forming apparatus according to claim 9, wherein the image formation unit includes an intermediate transfer member carrying an image, and wherein the alternating-current voltage is applied to the developer carrier or the electrode member in synchronization with output of the direct-current voltage to a cleaning unit that cleans the intermediate transfer member.

* * * * *